US010065085B2

(12) United States Patent
Seluga et al.

(10) Patent No.: US 10,065,085 B2
(45) **Date of Patent: *Sep. 4, 2018**

(54) GOLF CLUB HEAD HAVING FACE STRESS-REDUCTION FEATURES

(71) Applicant: Callaway Golf Company, Carlsbad, CA (US)

(72) Inventors: James A. Seluga, Carlsbad, CA (US); Matthew Myers, Carlsbad, CA (US); Denver Holt, Carlsbad, CA (US); Evan D. Gibbs, Encinitas, CA (US); Christopher A. G. Nunez, Escondido, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/443,448

(22) Filed: Feb. 27, 2017

(65) Prior Publication Data

US 2017/0165541 A1 Jun. 15, 2017

Related U.S. Application Data

(63) Continuation of application No. 15/005,875, filed on Jan. 25, 2016, now Pat. No. 9,597,561, which is a (Continued)

(51) Int. Cl.
*A63B 53/04* (2015.01)
*A63B 53/06* (2015.01)

(Continued)

(52) U.S. Cl.
CPC ..... *A63B 53/0466* (2013.01); *A63B 53/06* (2013.01); *A63B 60/04* (2015.10);

(Continued)

(58) Field of Classification Search
CPC ..... A63B 53/0466; A63B 53/06; A63B 60/52; A63B 60/04; A63B 2053/045;

(Continued)

(56) References Cited

U.S. PATENT DOCUMENTS 3,652,094 A 3/1972 Glover
4,872,684 A * 10/1989 Dippel ..... A63B 53/0487 273/DIG. 11

(Continued)

FOREIGN PATENT DOCUMENTS

JP 01043278 2/1989
JP 3821516 9/2006
JP 2007267777 10/2007

OTHER PUBLICATIONS

Non-Final Office Action dated Feb. 23, 2017, U.S. Appl. No. 15/385,549.

(Continued)

*Primary Examiner* — Sebastiano Passaniti
(74) *Attorney, Agent, or Firm* — Rebecca Hanovice; Michael Catania; Sonia Lari

(57) ABSTRACT

A golf club head comprising a body, at least one weight cartridge, and a plurality of hollow tubes is disclosed herein. The body comprises a face section, a sole section, and a return section, and also defines a hollow interior. Each of the plurality of hollow tubes extends from the return section to the sole section to reduce stresses placed on the face during impact with a golf ball, and the at least one weight cartridge is sized to fit within at least one of the plurality of hollow tubes. The sole section and return section each comprise keyed apertures providing access to the hollow tubes with which they communicate, and the at least one weight cartridge comprises a keyed structure sized to fit through the keyed apertures.

16 Claims, 3 Drawing Sheets

Related U.S. Application Data continuation-in-part of application No. 14/847,227, filed on Sep. 8, 2015, now Pat. No. 9,486,677, which is a continuation-in-part of application No. 14/788,326, filed on Jun. 30, 2015, now Pat. No. 9,597,558, and a continuation-in-part of application No. 14/794,578, filed on Jul. 8, 2015.

(51) Int. Cl.
*A63B 60/04* (2015.01)
*A63B 60/52* (2015.01)
*A63B 60/42* (2015.01)

(52) U.S. Cl.
CPC ..... *A63B 60/52* (2015.10); *A63B 60/42* (2015.10); *A63B 2053/045* (2013.01); *A63B 2053/0408* (2013.01); *A63B 2053/0412* (2013.01); *A63B 2053/0416* (2013.01); *A63B 2053/0433* (2013.01); *A63B 2053/0454* (2013.01); *A63B 2053/0458* (2013.01); *A63B 2053/0491* (2013.01); *A63B 2053/0495* (2013.01); *A63B 2209/00* (2013.01)

(58) Field of Classification Search
CPC .... A63B 2053/0433; A63B 2053/0491; A63B 2053/0408; A63B 2053/0495; A63B 2053/0412; A63B 2053/0454; A63B 2053/0458; A63B 2053/0416; A63B 2209/00; A63B 60/42
USPC ..... 473/324–350, 287–292, 313–314, 473/244–248
See application file for complete search history.

(56) References Cited

U.S. PATENT DOCUMENTS 5,766,094 A 6/1998 Mahaffey et al.
6,299,547 B1 10/2001 Kosmatka
6,332,847 B2 12/2001 Murphy et al.
6,368,234 B1 * 4/2002 Galloway ..... B21J 5/00 473/324
6,383,090 B1 5/2002 O'Doherty et al.
6,435,978 B1 8/2002 Galloway et al.
6,475,100 B1 11/2002 Helmstetter et al.
6,524,197 B2 2/2003 Boone
6,852,038 B2 2/2005 Yabu
6,979,270 B1 12/2005 Allen
7,066,835 B2 6/2006 Evans et al.
7,108,609 B2 9/2006 Stites et al.
7,166,041 B2 1/2007 Evans
7,351,161 B2 4/2008 Beach
7,387,579 B2 6/2008 Lin et al.
7,445,563 B1 11/2008 Werner
7,611,424 B2 * 11/2009 Nagai ..... A63B 53/0466 473/334
7,691,006 B1 4/2010 Burke
7,914,393 B2 3/2011 Hirsch et al.
8,523,702 B2 9/2013 Thomas et al.
8,540,587 B2 9/2013 Hirsch et al.
8,591,352 B2 11/2013 Hirano
8,608,585 B2 12/2013 Stites et al.
8,663,027 B2 3/2014 Morales et al.
8,834,293 B2 9/2014 Thomas et al.
8,834,294 B1 * 9/2014 Seluga ..... A63B 53/04 473/338
8,956,244 B1 * 2/2015 Westrum ..... A63B 53/04 473/338
9,067,110 B1 * 6/2015 Seluga ..... A63B 53/06
9,079,078 B2 7/2015 Greensmith et al.
9,180,349 B1 * 11/2015 Seluga ..... A63B 53/04
9,216,332 B1 * 12/2015 Ehlers ..... A63B 53/06
9,259,627 B1 * 2/2016 Myers ..... A63B 53/04
9,333,390 B1 * 5/2016 Manwaring ..... A63B 24/0003
9,345,936 B1 * 5/2016 Westrum ..... A63B 53/04
9,352,199 B2 * 5/2016 Seluga ..... A63B 53/06
9,486,677 B1 * 11/2016 Seluga ..... A63B 53/0466
9,597,558 B1 * 3/2017 Seluga ..... A63B 53/0466
9,597,561 B1 * 3/2017 Seluga ..... A63B 53/0466
9,623,302 B1 * 4/2017 Myers ..... A63B 53/06
9,675,856 B1 * 6/2017 Gibbs ..... A63B 53/06
9,687,701 B1 * 6/2017 Seluga ..... A63B 53/0466
9,687,702 B1 * 6/2017 Seluga ..... A63B 53/0466
9,694,257 B1 * 7/2017 Seluga ..... A63B 53/0466
9,757,629 B2 * 9/2017 Seluga ..... A63B 53/0466
9,776,058 B2 * 10/2017 Seluga ..... A63B 53/0466
9,782,646 B2 * 10/2017 Seluga ..... A63B 53/06
9,814,947 B1 * 11/2017 Seluga ..... A63B 53/0466
9,814,954 B2 * 11/2017 Westrum ..... A63B 53/06
9,821,199 B1 * 11/2017 Seluga ..... A63B 53/0466
9,827,469 B1 * 11/2017 Seluga ..... A63B 53/0466
9,855,476 B2 * 1/2018 Seluga ..... A63B 53/0466
9,889,349 B1 * 2/2018 Seluga ..... A63B 53/0466
2006/0122004 A1 * 6/2006 Chen ..... A63B 53/0466 473/335
2010/0304887 A1 12/2010 Bennett et al.
2010/0331101 A1 12/2010 Sato et al.
2015/0165280 A1 6/2015 Hebreo

OTHER PUBLICATIONS

Final Office Action dated Feb. 21, 2017, U.S. Appl. No. 14/794,578.
Final Office Action dated Feb. 21, 2017, U.S. Appl. No. 14/997,199.
Final Office Action dated Mar. 24, 2017, U.S. Appl. No. 15/063,107.
Non-Final Office Action dated Jun. 28, 2016, U.S. Appl. No. 15/013,052.
Non-Final Office Action dated Jun. 29, 2016, U.S. Appl. No. 14/794,578.
Non-Final Office Action dated Apr. 21, 2016, U.S. Appl. No. 14/794,578.
Non-Final Office Action dated Jan. 14, 2016, U.S. Appl. No. 14/794,578.
Non-Final Office Action dated Jun. 28, 2016, U.S. Appl. No. 15/011,313.
Non-Final Office Action dated Jul. 12, 2016, U.S. Appl. No. 14/997,199.
Non-Final Office Action dated Jul. 11, 2016, U.S. Appl. No. 15/063,107.
Non-Final Office Action dated Jul. 22, 2016, U.S. Appl. No. 15/051,361.
Non-Final Office Action dated Sep. 8, 2016, U.S. Appl. No. 14/847,227.
Non-Final Office Action dated Apr. 17, 2017, U.S. Appl. No. 15/447,638.
Non-Final Office Action dated Apr. 17, 2017, U.S. Appl. No. 15/446,754.
Non-Final Office Action dated Apr. 20, 2017, U.S. Appl. No. 15/279,188.

* cited by examiner

GOLF CLUB HEAD HAVING FACE STRESS-REDUCTION FEATURES

CROSS REFERENCES TO RELATED APPLICATIONS

The present invention is a continuation of U.S. patent application Ser. No. 15/005,875, filed on Jan. 25, 2016, which is a continuation-in-part of U.S. patent application Ser. No. 14/847,227, filed on Sep. 8, 2015, which is a continuation-in-part of U.S. patent application Ser. No. 14/788,326, filed on Jun. 30, 2015, and is also a continuation-in-part of U.S. patent application Ser. No. 14/794,578, filed on Jul. 8, 2015, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head. More specifically, the present invention relates to a golf club head with stress-reduction tubes disposed proximate the face.

Description of the Related Art

The prior art discloses various golf club heads having interior structures. For example, Yabu, U.S. Pat. No. 6,852,038 for a Golf Club Head And Method OF Making The Same, discloses a golf club head with a sound bar, Galloway, U.S. Pat. No. 7,118,493 for a Multiple Material Golf Club Head discloses a golf club head with a composite aft body having an interior sound component extending upward from a sole section of a metal face component, Seluga et al., U.S. Pat. No. 8,834,294 for a Golf Club Head With Center Of Gravity Adjustability discloses a golf club head with a tube having a mass for adjusting the center of gravity (CG) of a golf club head, and Dawson et al., U.S. Pat. No. 8,900,070 for a Weighted Golf Club Head discloses a golf club head with an interior weight lip extending from the sole towards the face. However, the prior art fails to disclose an interior structure that increases ball speed by reducing stress in the face at impact, with a minimal increase in mass to the golf club head, while at the same time permitting vertical adjustment of CG location.

BRIEF SUMMARY OF THE INVENTION

The golf club head comprises interior tubes to reduce the stress in a face during impact with a golf ball. One aspect of the present invention is a golf club head comprising a body and a plurality of tubes. The body comprises a face section, a sole section and a crown section. The body defines a hollow interior. Each of the plurality of tubes extends from the crown section to the sole section proximate the face. Each of the tubes may be composed of composite or a high-strength metal such as steel or titanium, and may receive a narrow, cylindrical weight adjustment cartridge having a heavy end and a lightweight end and keyed locking features.

Another aspect of the present invention is a golf club head comprising a body comprising a striking face, a sole, and a return section, the body defining a hollow interior, a plurality of hollow tubes, each of the plurality of hollow tubes extending from the return section to the sole, and at least one weight cartridge sized to fit within at least one of the plurality of hollow tubes, wherein the return section comprises a first plurality of apertures, wherein the sole comprises a second plurality of apertures, wherein each of the first plurality of apertures corresponds to a hollow tube of the plurality of hollow tubes, wherein each of the second plurality of apertures corresponds to a hollow tube of the plurality of hollow tubes, and wherein each of the plurality of hollow tubes is disposed within 11 millimeters of an interior surface of the striking face. In some embodiments, each of the first plurality of apertures and the second plurality of apertures may comprise a keyed structure, the at least one weight cartridge may comprise at least one keyed cover sized to fit within the keyed structure, and rotating the at least one weight cartridge within a hollow tube may reversibly lock the at least one weight cartridge within the hollow tube.

In other embodiments, the plurality of hollow tubes may range from two to eight hollow tubes, or the sole may comprise a plurality of bosses, each of which may correspond to a hollow tube of the plurality of hollow tubes. In some embodiments, the at least one weight cartridge may comprise a heavy end, which may have a high-density weight, and a lightweight end. In some embodiments, each of the plurality of hollow tubes may have a length ranging from 30 millimeters to 60 millimeters, and each of the plurality of hollow tubes may be composed of a titanium alloy. The body may be composed of a titanium alloy, steel, or carbon composite, and the golf club head may further comprise a composite crown section. In any of the embodiments, the golf club head may have a volume ranging from 200 cubic centimeters to 475 cubic centimeters.

In some embodiments, the at least one weight cartridge may comprise three weight cartridges, the plurality of hollow tubes may comprise three hollow tubes, and each of the three weight cartridges may be disposed in one of the hollow tubes. In other embodiments, the golf club head may further comprise a slidable weight, the sole may comprise a channel, and the slidable weight may be disposed within the channel. In a further embodiment, the channel may comprise at least one rail, and the slidable weight may be reversibly affixed to the at least one rail with a mechanical fastener.

Yet another aspect of the present invention is a driver-type golf club head comprising a metal body comprising a striking face, a sole, and a return section, the body defining a hollow interior, a composite crown section, a plurality of hollow titanium tubes, each of the plurality of hollow titanium tubes extending from the return section to the sole, and at least one weight cartridge sized to fit within at least one of the plurality of hollow titanium tubes, wherein the return section comprises a first plurality of apertures, wherein the sole comprises a second plurality of apertures, wherein each of the first plurality of apertures corresponds to a hollow titanium tube of the plurality of hollow titanium tubes, wherein each of the second plurality of apertures corresponds to a hollow titanium tube of the plurality of hollow titanium tubes, wherein each of the first plurality of apertures and the second plurality of apertures comprises a keyed structure, wherein the at least one weight cartridge comprises a heavy end, a lightweight end, and at least one keyed cover sized to fit within the keyed structure, and wherein rotating the at least one weight cartridge within a hollow tube reversibly locks the at least one weight cartridge within the hollow tube.

In some embodiments, the plurality of hollow titanium tubes may range from two to eight hollow titanium tubes, and the sole may comprise a plurality of bosses, each of which may correspond to a hollow titanium tube of the plurality of hollow titanium tubes. In other embodiments, each of the plurality of hollow titanium tubes may have a length ranging from 30 millimeters to 60 millimeters. In yet another embodiment, the striking face may comprise a variable thickness pattern.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
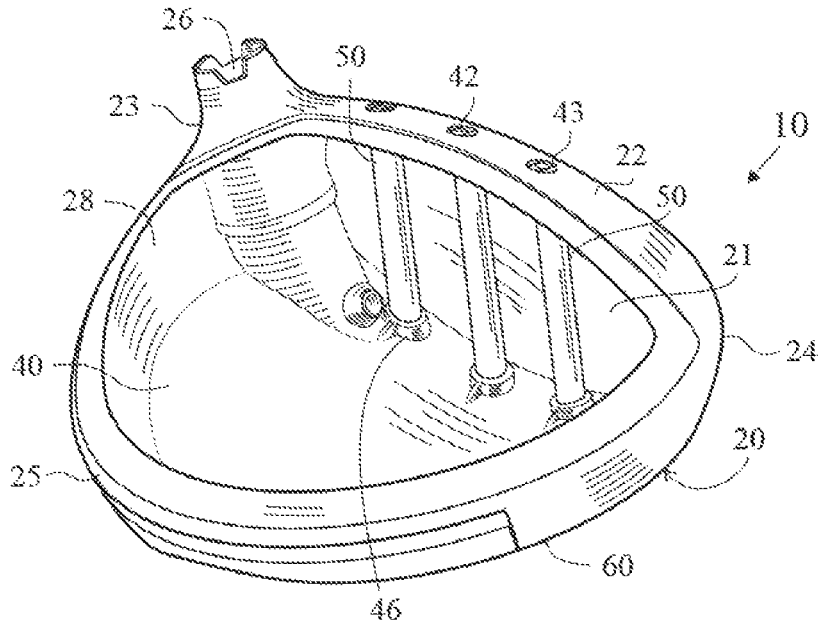
FIG. 1 is a top perspective view of the golf club head of the present invention with a crown section removed to illustrate an interior.
Figure 2:
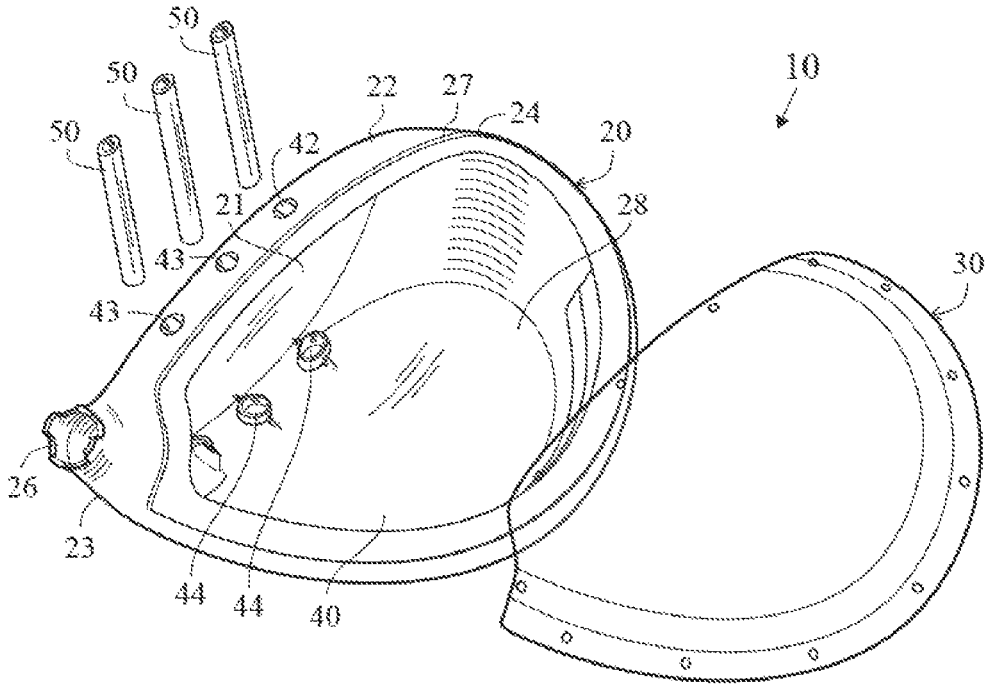
FIG. 2 is a top perspective, exploded view of the golf club head shown in FIG. 1.
Figure 3:
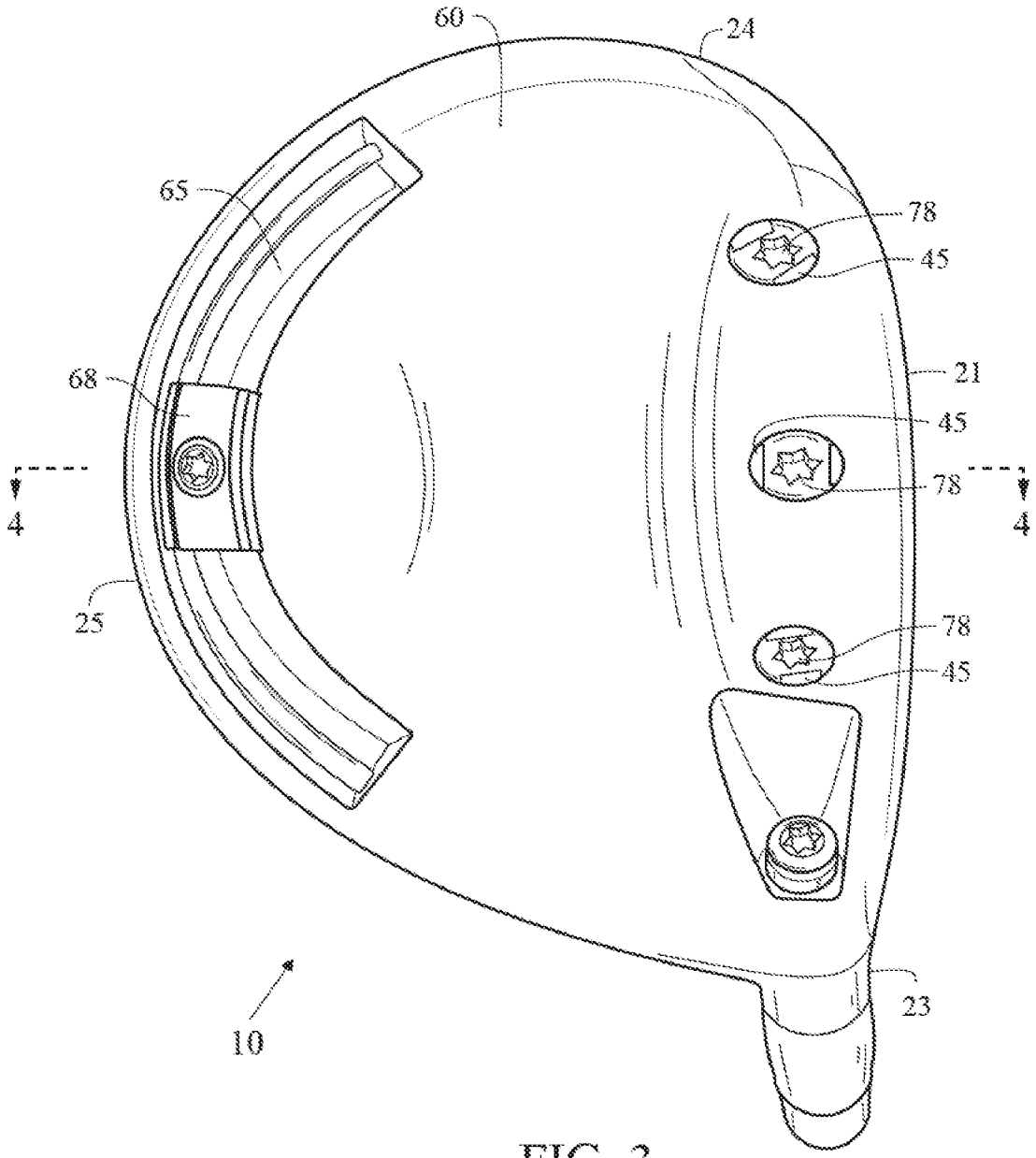
FIG. 3 is a bottom elevational view of the golf club head shown in FIG. 1.

As shown in FIGS. 1-5, a preferred embodiment of the golf club head 10 of the present invention is generally designated. The golf club head 10 preferably includes a body 20 having a striking face 21, a return section 22, a heel end 23, a toe end 24, an aft end 25, a hosel 26, a bond flange 27, an upper opening 28, and a sole 60. A crown 30 is placed over an upper opening 28 in the body 20 and is permanently bonded to the body 20 along the bond flange 27 so that the crown 30 is flush with the return section 22. The body 20, along with the crown 30, preferably defines a hollow interior 40. Within the hollow interior, multiple hollow tubes 50 extend from the sole 60 upward to the return section 22.

The plurality of tubes 50 preferably comprises two to eight tubes. Each of the plurality of tubes 50 preferably has a diameter ranging from 2 to 5 millimeters and a length ranging from 30 to 60 millimeters. Each of the plurality of tubes 50 is preferably positioned within 11 millimeters of an interior surface of the striking face 21. The mass of each of the plurality of tubes 50 preferably ranges from 0.5 to 3 grams, more preferably from 1 to 2 grams, and most preferably each tube 50 has a mass of 1.5 grams.

The return section 22 preferably comprises a plurality of apertures 42, each of which preferably corresponds to a tube 50 of the plurality of tubes 50. The sole 60 also comprises a plurality of apertures 44, each leading to a boss 46 that extends into the hollow interior 40 of the body 20 and which preferably corresponds to a tube 50 of the plurality of tubes 50. The tubes 50 are preferably affixed in the bosses 46 via bonding if the tubes 50 are made of carbon composite and via welding if the tubes 50 are made of a metal such as titanium or steel.

Figure 4:
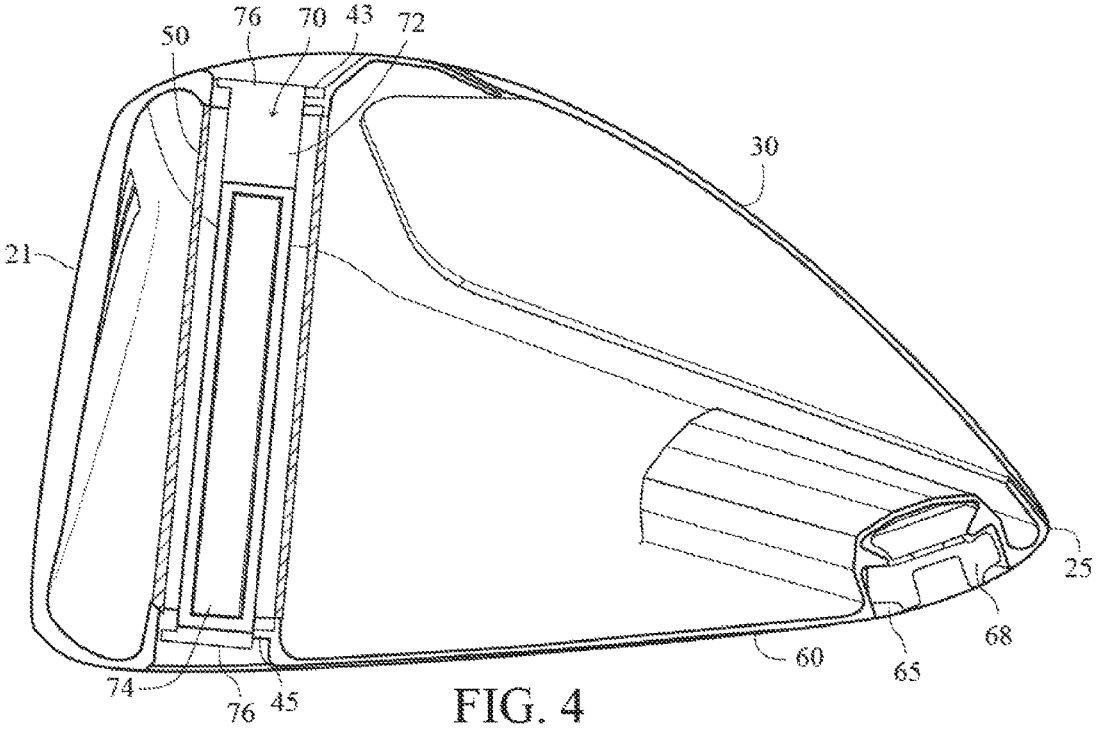
FIG. 4 is a cross-sectional view of the golf club head shown in FIG. 3 along lines 4-4.
Figure 5:
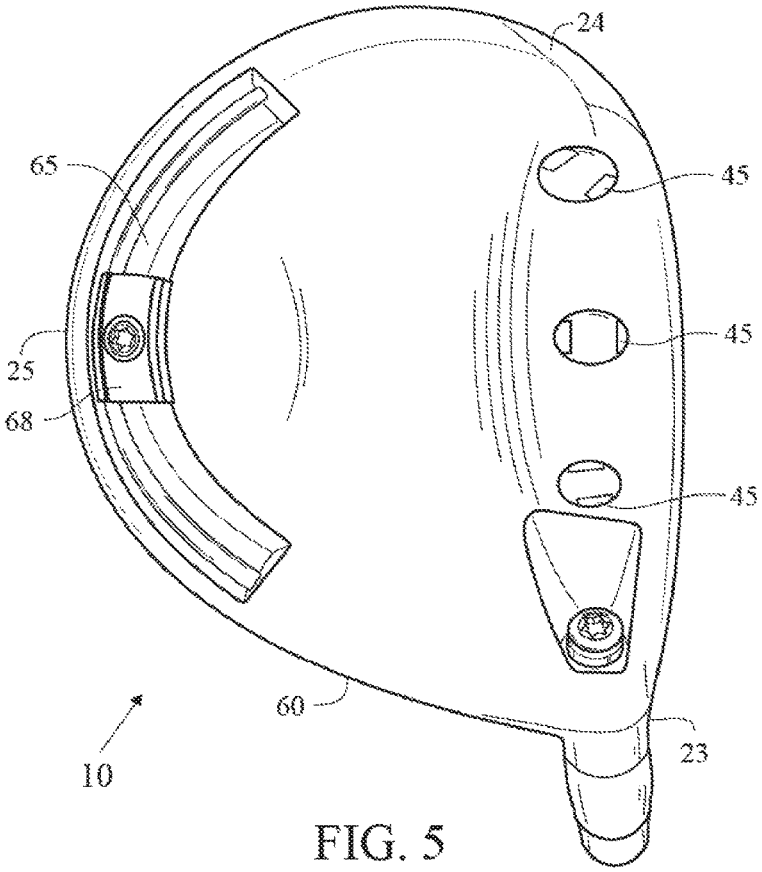
FIG. 5 is a bottom elevational view of the golf club head shown in FIG. 3 with the weight cartridges removed.

Each of the hollow tubes 50 is sized to receive a narrow weight cartridge 70, such as the one shown in FIG. 4. The weight cartridge 70 may have any of the features disclosed in U.S. Pat. Nos. 8,834,294 and 9,067,110, the disclosure of each of which is incorporated by reference in its entirety herein, but at the very least the weight cartridge 70 preferably has a heavy end 72 comprising a high-density weight and a lightweight end 74, each of which has a keyed, cam-shaped cover feature 76 with a tool-engaging structure 78. Each of the apertures 42, 44 in the body has a keyed structure 43, 45 sized to receive the keyed, cam-shaped cover feature 76 and to allow it to lock when a golfer uses a tool (not shown) to engage the tool-engaging structure 78 and rotate the weight cartridge 70 within the tube 50. The keyed, cam-shaped cover features 76 and the keyed structures 43, 45 may have any of the structures, and interact in any of the ways, described in U.S. patent application Ser. No. 14/216,971 and Ser. No. 14/823,834, the disclosure of each of which is incorporated by reference in its entirety herein.

In the preferred embodiment, a weight cartridge 70 is provided for each of the tubes 50 in the golf club head 10, but in an alternative embodiment, only one weight cartridge 70, which can fit in each of the plurality of tubes 50, is provided, and the golf club head 10 includes covers (not shown) for the apertures 42, 44 leading to unfilled tubes 50 so that no debris gets into the tubes 50 when the golf club head 10 is in use.

As shown in the Figures, the sole 60 comprises a channel 65 extending proximate the aft end 25 between the heel end 23 and the toe end 24 of the golf club head 10. The channel 65 is sized to receive a slidable weight 68. The channel 65 and slidable weight 68 may have any of the characteristics, dimensions, and functionality of the embodiments disclosed in U.S. Pat. Nos. 8,696,491, 8,894,506, 9,084,921, and 9,211,453, the disclosure of each of which is incorporated by reference in its entirety herein, or in U.S. patent application Ser. Nos. 14/174,068, 14/175,657, 14/216,971, 14/884,027, and Ser. No. 14/933,973, the disclosure of each of which is also incorporated by reference in its entirety herein.

In a preferred embodiment, the striking face 21 has a varying thickness such as described in U.S. Pat. No. 7,448,960, for a Golf Club Head With Variable Face Thickness, which pertinent parts are hereby incorporated by reference. Other alternative embodiments of the thickness of the striking face 21 are disclosed in U.S. Pat. No. 6,398,666, for a Golf Club Striking Plate With Variable Thickness, U.S. Pat. No. 6,471,603, for a Contoured Golf Club Face and U.S. Pat. No. 6,368,234, for a Golf Club Striking Plate Having Elliptical Regions Of Thickness, all of which are owned by Callaway Golf Company and which pertinent parts are hereby incorporated by reference. Alternatively, the face section has a uniform thickness.

The body 20 is preferably cast from molten metal in a method such as the well-known lost-wax casting method. The metal for casting is preferably titanium or a titanium alloy such as 6-4 titanium alloy, alpha-beta titanium alloy or beta titanium alloy for forging, and 6-4 titanium for casting. Alternatively, the body 20 is composed of 17-4 steel alloy. Additional methods for manufacturing the body 20 include forming the body 20 from a flat sheet of metal, super-plastic forming the body from a flat sheet of metal, machining the body 20 from a solid block of metal, electrochemical milling the body 20 from a forged pre-form, casting the body using centrifugal casting, casting the body 20 using levitation casting, and like manufacturing methods. Alternatively, the body 20 may be formed from a carbon composite material, including any of the materials disclosed in U.S. Pat. No. 9,033,822, the disclosure of which is incorporated by reference in its entirety herein.

The golf club head 10, when designed as a driver, preferably has a volume from 200 cubic centimeters to 600 cubic centimeters, more preferably from 300 cubic centimeters to 500 cubic centimeters, and most preferably from 420 cubic centimeters to 470 cubic centimeters, with a most preferred volume of 460 cubic centimeters. The volume of the golf club head 10 will also vary between fairway woods (preferably ranging from 3-woods to eleven woods) with smaller volumes than drivers.

The golf club head 10, when designed as a driver, preferably has a mass no more than 215 grams, and most preferably a mass of 180 to 215 grams. When the golf club head 10 is designed as a fairway wood, the golf club head preferably has a mass of 135 grams to 200 grams, and preferably from 140 grams to 165 grams.

A preferred embodiment of the golf club head 10 has a volume of 460 cubic centimeters with the Characteristic Time (CT) of the face close to, but not exceeding 257 microsecond ("μS") limit set by the USGA.

In other embodiments, the golf club head 10 may have a multi-material composition such as any of those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A golf club head comprising:

a body comprising a striking face, a sole, and a return section, the body defining a hollow interior, and the sole and return section defining an upper opening;

a plurality of titanium tubes, each of the plurality of titanium tubes extending within the hollow interior from the return section to the sole;

a crown section sized to cover the upper opening; and at least one weight cartridge sized to fit within at least one of the plurality of titanium tubes, wherein the plurality of titanium tubes ranges from two to eight titanium tubes, wherein the sole comprises a plurality of bosses, wherein each of the plurality of bosses corresponds to a titanium tube of the plurality of titanium tubes, wherein each of the plurality of titanium tubes has a length ranging from 30 millimeters to 60 millimeters, wherein each of the plurality of titanium tubes is disposed within 11 millimeters of an interior surface of the striking face, wherein the plurality of titanium tubes increases ball speed by reducing stress placed on the striking face during impact with a golf ball, and wherein the striking face has a characteristic time that is close to, but does not exceed, 257 microseconds.

2. The golf club head according to claim 1, wherein the return section comprises a first plurality of apertures, wherein the sole comprises a second plurality of apertures, wherein each of the first plurality of apertures corresponds to a titanium tube of the plurality of titanium tubes, and wherein each of the second plurality of apertures corresponds to a titanium tube of the plurality of hollow tubes.

3. The golf club head according to claim 2, wherein each of the first plurality of apertures and the second plurality of apertures comprises a keyed structure, wherein the at least one weight cartridge comprises at least one keyed cover sized to fit within the keyed structure, and wherein rotating the at least one weight cartridge within a titanium tube of the plurality of titanium tubes reversibly locks the at least one weight cartridge within the titanium tube.

4. The golf club head according to claim 1, wherein the at least one weight cartridge comprises a heavy end and a lightweight end.

5. The golf club head according to claim 4, wherein the heavy end comprises a high-density weight.

6. The golf club head according to claim 1, wherein the body is composed of material selected from the group consisting of titanium alloy and steel.

7. The golf club head according to claim 6, wherein each of the plurality of titanium tubes is welded to the body.

8. The golf club head according to claim 1, wherein the crown section is composed of a composite material.

9. The golf club head according to claim 1, wherein the golf club head has a volume ranging from 200 cubic centimeters to 475 cubic centimeters.

10. The golf club head according to claim 1, wherein the body is composed of carbon composite material.

11. The golf club head according to claim 1, wherein the at least one weight cartridge comprises three weight cartridges, wherein the plurality of titanium tubes comprises three titanium tubes, and wherein each of the three weight cartridges is disposed, respectively, in one of the three titanium tubes.

12. The golf club head according to claim 1, further comprising a slidable weight, wherein the sole comprises a channel, and wherein the slidable weight is disposed within the channel.

13. The golf club head according to claim 12, wherein the channel comprises at least one rail, and wherein the slidable weight is reversibly affixed to the at least one rail with a mechanical fastener.

14. A driver-type golf club head comprising:

a metal body comprising a striking face, a sole, and a return section, the body defining a hollow interior, the return section and sole defining an upper opening;

a composite crown section sized to close the upper opening;

a plurality of titanium tubes, each of the plurality of titanium tubes extending from the return section to the sole proximate an interior surface of the striking face; and a weight cartridge sized to fit within at least one of the plurality of titanium tubes, wherein the striking face comprises a variable thickness pattern, wherein each titanium tube of the plurality of titanium tubes is welded to the body, wherein the weight cartridge comprises a heavy end and a lightweight end, wherein the plurality of titanium tubes ranges from two to eight titanium tubes, wherein the sole comprises a plurality of bosses, wherein each of the plurality of bosses corresponds to a titanium tube of the plurality of titanium tubes, wherein each of the plurality of hollow titanium tubes has a length ranging from 30 millimeters to 60 millimeters and a diameter ranging from 2 millimeters to 5 millimeters, wherein the plurality of titanium tubes increases ball speed by reducing stress placed on the striking face during impact with a golf ball, and wherein the striking face has a characteristic time that is close to, but does not exceed, 257 microseconds.

15. The golf club head according to claim 14, wherein the return section comprises a first plurality of apertures, wherein the sole comprises a second plurality of apertures, wherein each of the first plurality of apertures corresponds to a titanium tube of the plurality of titanium tubes, and wherein each of the second plurality of apertures corresponds to a titanium tube of the plurality of titanium tubes.

16. The golf club head according to claim 15, wherein each of the first plurality of apertures and the second plurality of apertures comprises a keyed structure, wherein the weight cartridge comprises at least one keyed cover sized to fit within the keyed structure, and wherein rotating the weight cartridge within a titanium tube reversibly locks the weight cartridge within that titanium tube.

* * * * *